US007255342B2

(12) United States Patent
Gregoire et al.

(10) Patent No.: US 7,255,342 B2
(45) Date of Patent: Aug. 14, 2007

(54) ANTI-SKEW DEVICE FOR MAIL PROCESSING MACHINE

(75) Inventors: Jean-Pierre Gregoire, Brie Comte Robert (FR); Alain Multignier, Aulnay Sous Bois (FR); Roman Rackwitz, Paris (FR)

(73) Assignee: Neopost Industrie, Bagneux (FR)

( * ) Notice: Subject to any disclaimer, the term of this patent is extended or adjusted under 35 U.S.C. 154(b) by 319 days.

(21) Appl. No.: 10/913,061

(22) Filed: Aug. 5, 2004

(65) Prior Publication Data

US 2006/0033260 A1 Feb. 16, 2006

(51) Int. Cl.
*B65H 9/00* (2006.01)

(52) U.S. Cl. ..... 271/234; 271/239; 271/226

(58) Field of Classification Search ..... 271/226, 271/239, 234, 248, 253, 2
See application file for complete search history.

(56) References Cited

U.S. PATENT DOCUMENTS 3,356,364 A 12/1967 Grigereit et al. ..... 271/60
4,638,989 A * 1/1987 Senoo ..... 271/227
5,080,345 A * 1/1992 Daniels ..... 271/239
5,316,288 A * 5/1994 Fish et al. ..... 271/250
6,523,822 B1 2/2003 Galtier et al. ..... 271/171

FOREIGN PATENT DOCUMENTS

EP 0 590 285 8/1993

OTHER PUBLICATIONS

Patent Abstracts of Japan, Publication No. 60012427.

* cited by examiner

*Primary Examiner*—David H. Bollinger
*Assistant Examiner*—Kaitlin S Joerger
(74) *Attorney, Agent, or Firm*—Perman & Green, LLP

(57) ABSTRACT

In a mail processing machine comprising a reception plate for receiving, in the form of a stack of items, the mail items to be printed, a jogging means for jogging this stack of items against a reference wall, a selection means for extracting the mail items to be printed from this stack of items one by one, and a printing means for printing a postal stamp on the selected mail item, an anti-skew device is provided, comprising a plurality of pivoting levers which are each positioned at a defined distance from the reference wall and a first end of which extends through an orifice made in the reception plate, in order to form, above the plate, a removable lateral obstacle for the mail items. These defined distances each correspond to a width of envelope of different format.

10 Claims, 3 Drawing Sheets

FIG.2
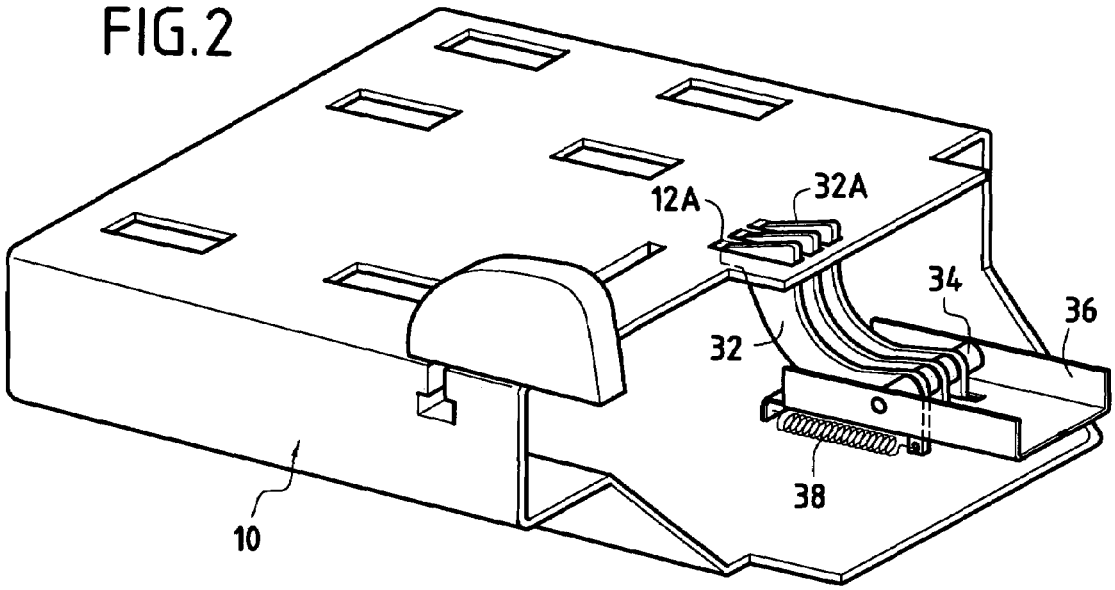
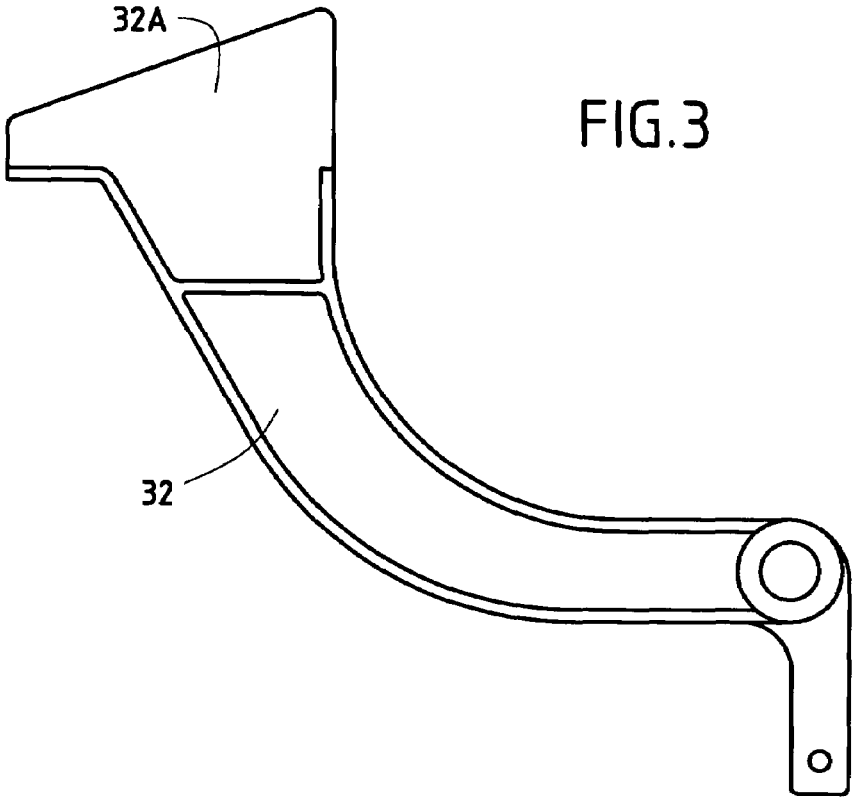
FIG.3

ANTI-SKEW DEVICE FOR MAIL PROCESSING MACHINE

TECHNICAL FIELD

The present invention relates solely to the field of mail processing, and it is concerned more particularly with a device for preventing the skewing of mail items during their introduction into a mail processing machine.

PRIOR ART

Conventionally, the anti-skew (or anti-slant) function is performed by the mail-item jogging device which acts directly on the lateral positioning of the mail items. However, this function is ensured efficiently only if the jogged mail items are of the same dimension. To be precise, as regards mail of different dimensions (bulk mail), this jogging is carried out on the mail items having the largest dimensions. This then results, for the articles having smaller dimensions, in the possibility of appreciable skewing.

OBJECT AND DEFINITION OF THE INVENTION

The object of the present invention is, therefore, to mitigate this disadvantage by means of a device making it possible to prevent this skewing, particularly during the feeding of bulk mail items. One purpose of the invention is also to provide a device easily adaptable to the various formats of mail items which arise due to separate postal standards, without any special modification to its structure. Another purpose of the invention is to provide a device of which the integration into the traditional mail processing machine is easy to implement, without the need to redefine the general architecture of this machine.

These purposes are achieved by means of an anti-skew device for a mail processing machine comprising a reception plate for receiving, in the form of a stack of items, the mail items to be printed, a jogging means for jogging this stack of items against a reference wall, a selection means for extracting the mail items to be printed from this stack of items one by one, and a printing means for printing a postal stamp on the selected mail item, characterized in that it comprises a plurality of retractable members which are each positioned at a defined distance from the said reference wall and a first end of which extends through an orifice made in the said reception plate in order to form, above the said plate, a removable lateral obstacle for the mail items.

Thus, by means of this simple structure, as it were a dynamic jogging of each mail item is carried out, and the latter can then be presented in an optimum way to the selection machines of the mail processing machine. The defined distances each correspond to a width of envelope of different format. Preferably, the said first end has a triangular shape. The number of orifices made in the reception plate may be greater than the number of retractable members.

According to a preferred embodiment, the anti-skew device for a mail processing machine according to the invention comprises retractable members consisting of at least two pivoting levers. The pivoting levers are articulated on a common shaft secured to a frame of the mail processing machine by means of a supporting bar, and each of the said pivoting levers comprises a second end connected to an elastic element secured to this supporting bar.

BRIEF DESCRIPTION OF THE DRAWINGS

The invention will be understood more clearly from the following detailed description accompanied by illustrative and non-limiting examples with reference to the following figures in which:

FIG. 2 illustrates the anti-skew device of FIG. 1 in detail, FIG. 3 is an elevation view of an anti-skew lever of the anti-skew device of FIGS. 1 and 2.

DETAILED DESCRIPTION OF THE EMBODIMENTS

Figure 4:
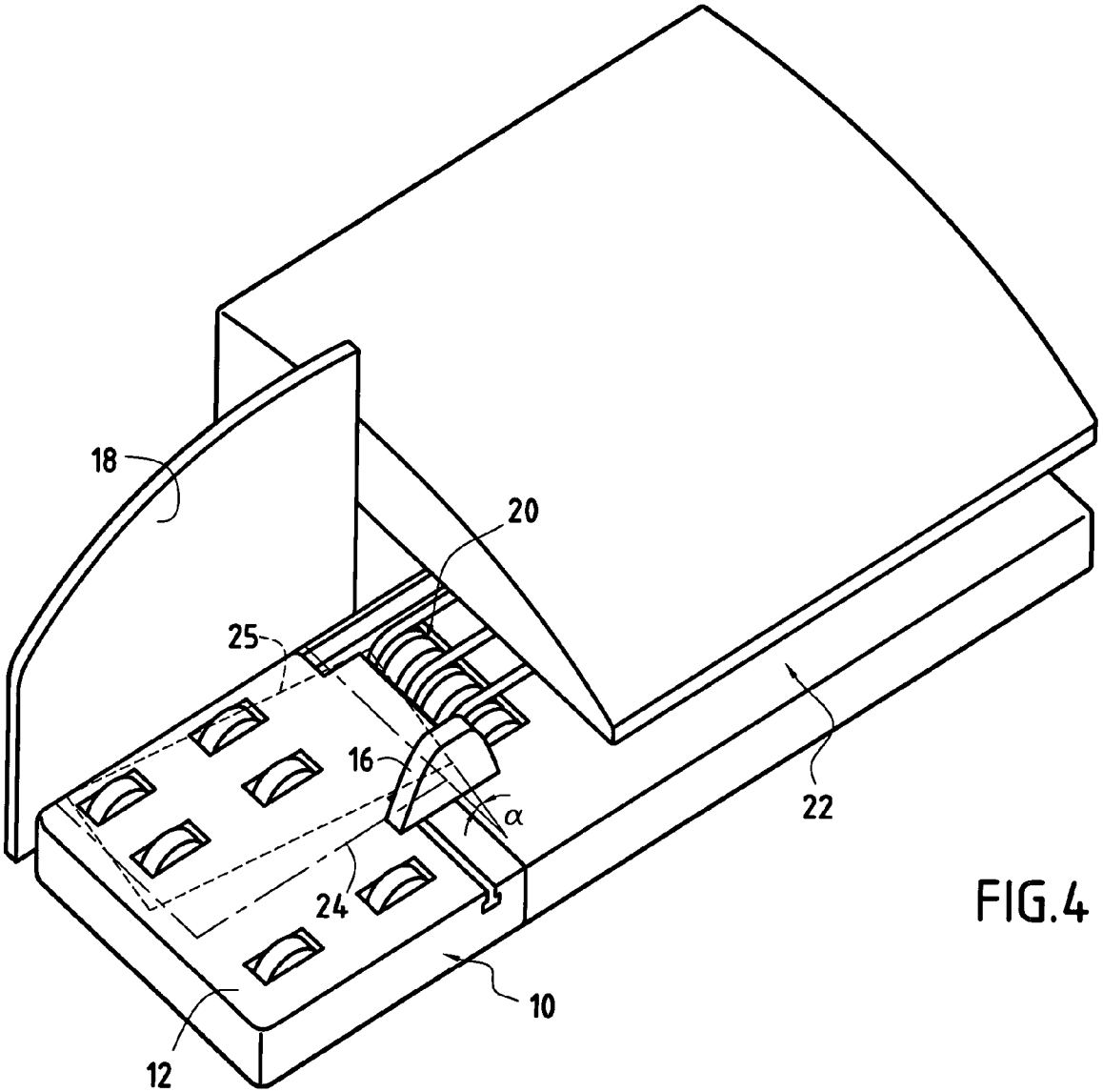
FIG. 4 illustrates in perspective a mail processing machine of the prior art.

A traditional mail processing machine is illustrated in FIG. 4. It conventionally comprises from upstream in a downstream direction (with respect to the direction of travel of the mail items through the machine): a feed station 10 equipped with a reception plate 12 onto which the mail items to be printed are placed in the form of a compact stack which is or is not uniform (depending on whether these items are or are not of the same dimension); driving rollers 14 and means for the jogging (advantageously, lateral 16 and/or rear) of these mail items against a reference wall 18; a selection station 20 for extracting the mail items to be printed from the bottom of the stack one by one; and a printing station 22 for printing a postal stamp on the mail item thus selected.

When the mail items are of the same dimensions, more specifically of the same width, the lateral jogging means ensure that these mail items always have a correct positioning on the selection means, that is to say with a position of the front of each mail item perpendicular with respect to the reference wall. By contrast, it is easily understood that, if a mail item 24 has a lesser width than that of the other jogged items 26, the position of its front may be at an angle $\alpha$ with respect to the perpendicular to this wall, so that its selection is carried out crookedly and the following printing may then be seriously impaired.

Figure 1:
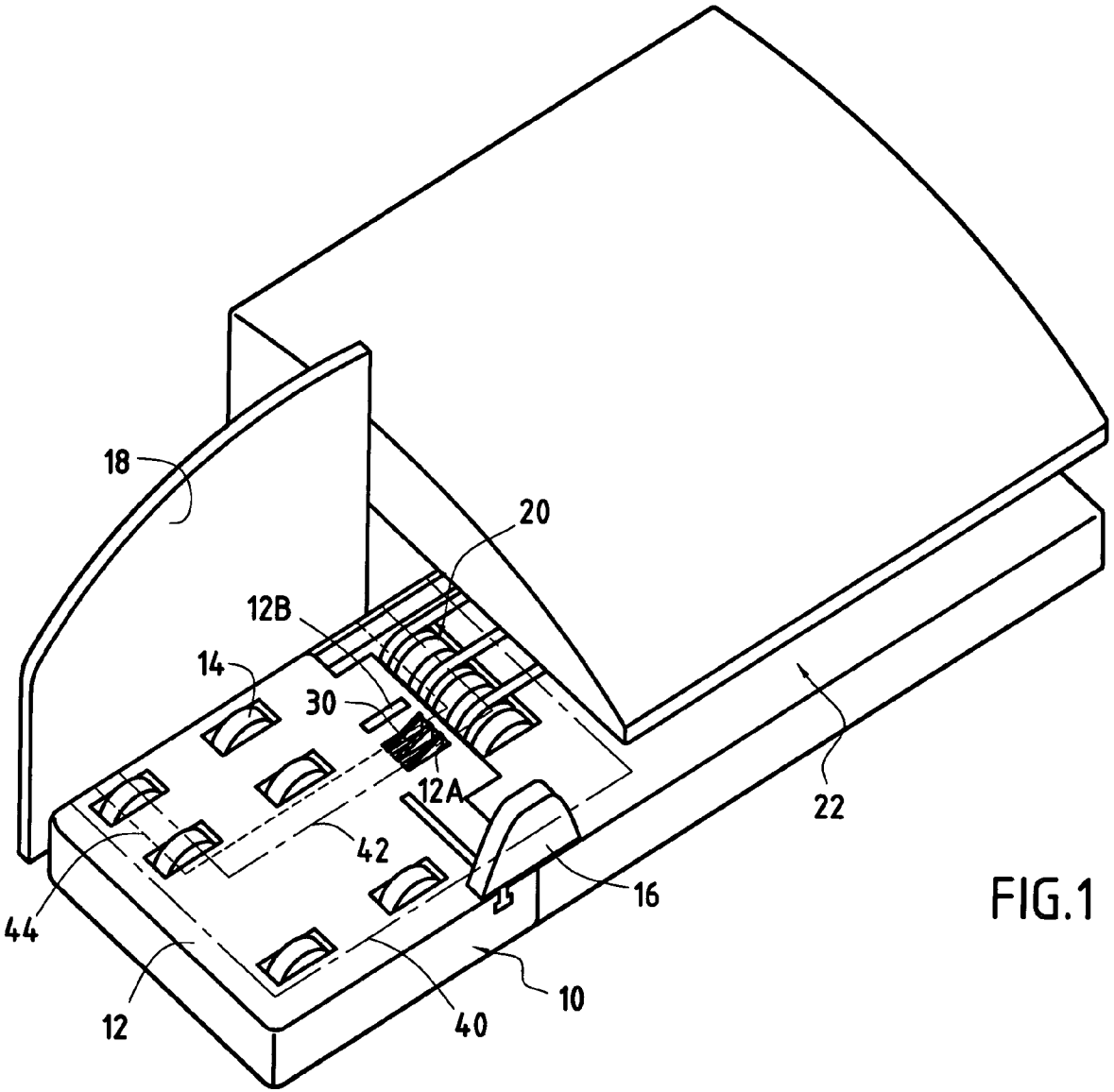
FIG. 1 shows in perspective a mail processing machine incorporating an anti-skew device according to the invention.

According to the invention, and as illustrated in FIGS. 1 and 2, there is provision for equipping the feed station with means 30 for preventing the skewing of the mail items stored in bulk on the reception plate 12 and jogged by the lateral jogging means 16. These means, formed from retractable members, comprise a plurality of anti-skew levers 32 (for example, three in number, as illustrated) articulated on a common shaft 34 mounted transversely with respect to the direction of advance of the mail items and secured at its two ends to the frame of the mail processing machine, more specifically to the reception plate of the feed station, by means of a supporting bar 36.

As shown clearly in FIG. 3, each pivoting lever, which has substantially a general swan-neck shape, comprises a first triangular end part 32A intended for passing through an orifice 12A made in the reception plate in order to define, above this reception plate, a movable lateral obstacle for the mail items. Attached to a second end part, opposite the first with respect to the joint, is attached a first end of an elastic element 38, the other end of which is secured to the supporting bar. This elastic element, for example a spring, is set so as not to impede the travel of the mail items and therefore to give way under the weight of a mail item, the width of which exceeds the distance between the reference wall and the lever, whilst at the same time effectively preventing the skewing of a mail item, the width of which corresponds to this distance of the reference wall from the lever, thereby forming a movable lateral jogging element for this item. To be precise, each lever 32 is positioned with respect to the reference wall 18, at a distance corresponding exactly to a width of envelope of a specific format different for each lever. For example, referring to the postal standards in force in the European territory, there may be provision for placing levers at the following three distances 114 mm, 125 mm and 140 mm, corresponding to the three typical formats known by the references C6, B6 and E6. There are also similar references in the U.S. territory. Of course, these values are given purely as an illustration, and any other combination of formats may be envisaged. It will also be noted that, by a sufficient number of additional orifices 12B being made, it is possible to have a universal device adaptable to both the European standard and to the U.S. standard, the configuration implemented then being defined by the number (then smaller than the number of orifices) and the location of the available levers in the machine.

Thus, by means of the present invention, the mail items stored in bulk on the reception plate 12, for example those designated by 40, 42 and 44 in FIG. 1, can be extracted one by one, whilst at the same time being held correctly against the reference wall 18. To be precise, if the mail items of larger dimension, such as 40 (defining the width of the stack), are jogged correctly by the jogging means 16, the article designated by 42 is likewise jogged correctly but by the third lever, the first and second levers then being retracted. As regards the mail item 44, the first lever forms its individual jogging means, preventing possible skewing.

The invention claimed is:

1. Anti-skew device for a mail processing machine comprising:

a reception plate for receiving, in the form of a stack of items, the mail items to be printed;

a jogging means for jogging this stack of items against a reference wall;

a selection means for extracting the mail items to be printed from this stack of items one by one;

a printing means configured to print a postal stamp on the selected mail item; and a plurality of retractable members each of which is positioned at a defined distance from the reference wall and a first end of which extends through an orifice made in the reception plate, in order to form, above the plate, a removable lateral obstacle for the mail items wherein each one of the retractable members is configured to be individually retracted by a weight of a mail item on a respective retractable member.

2. Anti-skew device for a mail processing machine according to claim 1, characterized in that each of the defined distances correspond to a width of an envelope of a different format.

3. Anti-skew device for a mail processing machine according to claim 1, characterized in that the first end has a triangular shape.

4. Anti-skew device for a mail processing machine according to claim 1, characterized in that the number of orifices made in the reception plate is greater than the number of retractable members.

5. Anti-skew device for a mail processing machine according to claim 1, characterized in that the retractable members consist of pivoting levers.

6. Anti-skew device for a mail processing machine according to claim 5, characterized in that it comprises at least two pivoting levers.

7. Anti-skew device for a mail processing machine according to claim 5, characterized in that the pivoting levers are articulated on a common shaft secured to a frame of the mail processing machine by means of a supporting bar.

8. Anti-skew device for a mail processing machine according to claim 7, characterized in that each of the pivoting levers comprises a second end connected to an elastic element of the supporting bar.

9. The device of claim 1, wherein each one of the retractable members is individually retracted when a width of the mail item exceeds the defined distance from the reference wall to the respective retractable member.

10. The device of claim 1, wherein each one of the retractable members within a path of the mail item is retracted when contacted by the mail item, and other non-contacted retractable members remain extended through a respective orifice in the reception plate.

* * * * *